US005504393A

United States Patent [19]

Kirshner

[11] Patent Number: 5,504,393

[45] Date of Patent: Apr. 2, 1996

[54] COMBINATION TUNER AND SECOND HARMONIC SUPPRESSOR FOR EXTENDED INTERACTION KLYSTRON

[75] Inventor: Mark F. Kirshner, Redwood City, Calif.

[73] Assignee: Litton Systems, Inc., Woodland Hills, Calif.

[21] Appl. No.: 235,498

[22] Filed: Apr. 29, 1994

[51] Int. Cl.[6] ..... H01J 23/20; H01J 23/54

[52] U.S. Cl. ..... 315/5.46; 315/5.48; 315/5.51; 315/5.53; 315/5.54; 333/251

[58] Field of Search ..... 315/5.39, 5.43, 315/5.46, 5.47, 5.48, 5.49, 5.51, 5.53, 5.54; 331/83; 330/45; 333/251

[56] References Cited

U.S. PATENT DOCUMENTS

| | | | |
|---|---|---|---|
| 2,944,183 | 7/1960 | Drexler | 315/5.46 |
| 2,970,242 | 1/1961 | Jepsen | 315/5.39 |
| 3,093,804 | 6/1963 | La Rue | 315/5.46 X |
| 3,142,028 | 7/1964 | Wanselow | 333/211 |
| 3,381,163 | 4/1968 | La Rue et al. | 315/5.39 |
| 3,720,889 | 3/1973 | Gale | 315/5.46 X |
| 4,188,600 | 2/1980 | Cavalieri D'Oro | 333/251 X |
| 4,284,922 | 8/1981 | Perring et al. | 315/5.39 |
| 4,851,788 | 7/1989 | Ives et al. | 315/5.51 X |
| 4,931,695 | 6/1990 | Symons | 315/5.39 |
| 5,304,942 | 4/1994 | Symons et al. | 330/45 |

FOREIGN PATENT DOCUMENTS

| | | | |
|---|---|---|---|
| 2005321 | 12/1993 | U.S.S.R. | 315/5.39 |
| 1199341 | 7/1970 | United Kingdom . | |
| 2098390 | 11/1982 | United Kingdom . | |

*Primary Examiner*—Benny T. Lee
*Attorney, Agent, or Firm*—Graham & James

[57] ABSTRACT

A combination tuner and harmonic suppressor apparatus is provided for a klystron having a gap defined across a resonant cavity. The apparatus comprises a back cavity coupled to the resonant cavity by a coupling iris. Harmonic resonances within the resonant cavity are conducted to the back cavity through the coupling iris. An absorber disposed within the back cavity absorbs and attenuates the energy of the harmonic resonances. The coupling iris can be capacitively tuned to optimally conduct the harmonic frequencies into the back cavity. The apparatus further comprises an open-ended diaphragm providing a wall of the resonant cavity, disposed between the back cavity and the resonant cavity. A bellows provides a barrier between a vacuum environment within the klystron and a non-vacuum environment external to the klystron, and enables a broad range of movement of the diaphragm.

30 Claims, 3 Drawing Sheets

FIG. 1
PRIOR ART
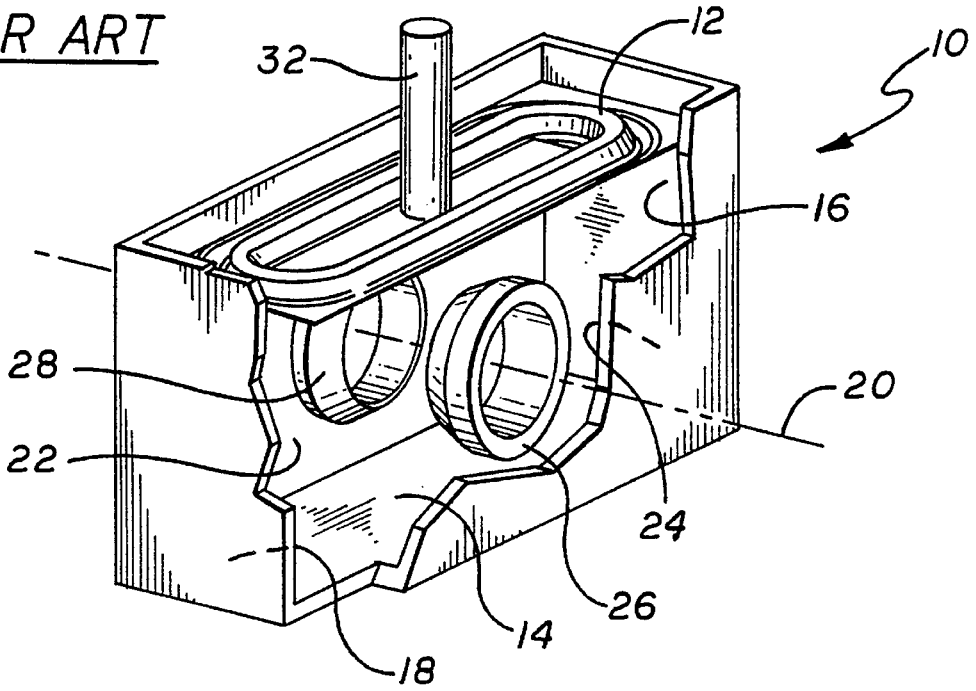
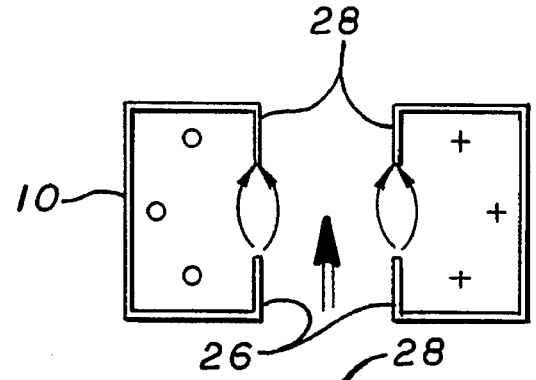
FIG. 2A
PRIOR ART
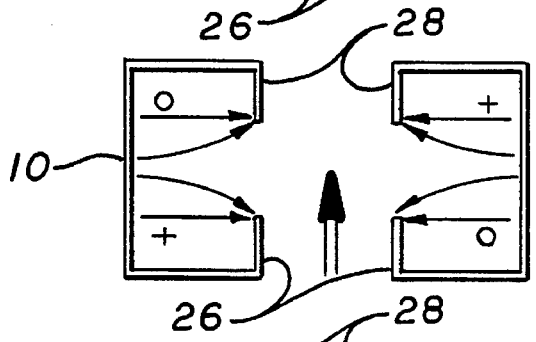
FIG. 2B
PRIOR ART
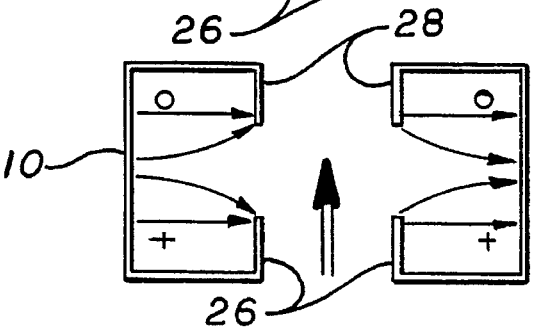
FIG. 2C
PRIOR ART

COMBINATION TUNER AND SECOND HARMONIC SUPPRESSOR FOR EXTENDED INTERACTION KLYSTRON

BACKGROUND OF THE INVENTION

1. Field of the Invention

The present invention relates to extended interaction klystrons having increased power, efficiency, and bandwidth, and more particularly, to a novel assembly for tuning klystron cavity resonance that additionally suppresses undesirable harmonic RF energy.

2. Description of Related Art

Linear beam tubes are used in sophisticated communication and radar systems which require amplification of an RF or microwave electromagnetic signal. A conventional klystron is an example of a linear beam microwave amplifier. A klystron comprises a number of cavities divided into essentially three sections: an input section, a buncher section, and an output section. An electron beam is sent through the klystron, and is velocity modulated by an RF electromagnetic input signal that is provided to the input section. In the buncher section, the electrons that have had their velocity increased gradually overtake the slower electrons, resulting in electron bunching. The traveling electron bunches represent an RF current in the electron beam. The RF current induces electromagnetic energy into the output section of the klystron as the bunched beam passes through the output cavity, and the electromagnetic energy is extracted from the klystron at the output section. An output waveguide channels the electromagnetic energy to an output device, such as an antenna.

Klystron amplifiers having large instantaneous bandwidth are provided by use of multi-cavity output circuits. The multi-cavity output circuits, known as extended interaction output circuits (EIOC), have the advantage that a higher level of impedance across a greater bandwidth can be achieved. The higher impedance enables better matching with the electron beam, leading to greater efficiency of operation. An EIOC used to produce high power microwave energy with large instantaneous bandwidth is referred to as an extended interaction klystron (EIK), and can be used to produce power over bandwidths in excess of 10%. Examples of high performance EIOCs are disclosed in U.S. Pat. Nos. 4,931,695, to Symons, and 5,304,942, to Symons et al.

Despite the advantages of EIKs in terms of power, efficiency, and instantaneous bandwidth, there are certain significant drawbacks. To insure that the klystron resonates within the proper frequency range, it is advantageous to include cavity tuners that are widely adjustable (in excess of 10% tuning range), rugged (i.e., able to survive numerous cycles and high power levels), and that do not adversely affect cavity R/Q (a figure of merit which directly relates to the gain-bandwidth product where R equals the shunt resistance of the cavity and Q equals the quality factor). Klystrons are often provided with an inductive tuning mechanism for adjusting the resonance of the klystron.

A typical inductive tuner for a klystron comprises a thin metallic diaphragm which serves as a movable wall of the resonant cavity. Adjustment of the diaphragm position alters the inductance of the cavity, thus changing its resonance characteristics. The diaphragm also serves to provide a part of the vacuum envelope for the klystron, and is therefore sealed to the klystron cavity around the entire circumference of the diaphragm. As a result, the range of motion of the diaphragm is limited due to its attachment to the cavity. The limited range of motion of such diaphragms is inadequate for the wide range of adjustment necessary for broad bandwidth klystrons. Moreover, excess movement of the diaphragm often causes cracking with the subsequent loss of vacuum within the klystron.

Notwithstanding the klystron tuning difficulties, a secondary problem with high efficiency klystrons is elevated harmonic levels within the cavity. Harmonics are an inevitable, but undesirable, by product of high efficiency klystron design. The harmonics are undesirable since energy devoted to the harmonics detracts from the signal purity and power of the fundamental frequency. Load mismatches at the output waveguide further aggravate this situation by reflecting back impedance levels which cause increased harmonic energy to be created. It is desirable, therefore, to damp out the harmonics within the klystron itself so that the levels are diminished sufficiently to prevent conditions outside the klystron, such as impedance mismatches at the output waveguide, from causing a problem.

Accordingly, it would be desirable to provide an apparatus for use with an EIK that enables a broad range of cavity tuning, and that suppresses undesired harmonic resonances encountered within the cavity. It would be further desirable to provide an apparatus having the above characteristics, while being relatively simple to design and cost effective to fabricate.

SUMMARY OF THE INVENTION

In accordance with the teachings of this invention, a combination tuner and harmonic suppressor apparatus is provided for a klystron having a gap defined across a resonant cavity. The apparatus comprises a back cavity coupled to the resonant cavity by a coupling iris. Harmonic resonances within the resonant cavity are conducted to the back cavity through the coupling iris. An absorber disposed within the back cavity absorbs and attenuates the energy of the harmonic resonances. The coupling iris can be capacitively tuned so that only the harmonic frequencies are conducted into the back cavity, and the fundamental frequency remains within the resonant cavity.

The apparatus further provides an inductive tuner to tune the resonant characteristics of the resonant cavity. The tuner comprises a diaphragm providing a wall of the resonant cavity, disposed between the back cavity and the resonant cavity. A bellows provides a barrier between a vacuum environment within the klystron and a non-vacuum environment external to the klystron, and enables the movement of the diaphragm. Since the diaphragm does not provide the vacuum envelope for the klystron, it is possible to have the diaphragm open at side edges thereof, increasing the range of motion of the diaphragm. The coupling iris is disposed between a side edge of the diaphragm and a side of the resonant cavity. The use of the bellows moves the vacuum envelope away from the diaphragm, so that cracking of the diaphragm is not catastrophic to operation of the klystron.

A more complete understanding of the combination tuner and second harmonic suppressor for an extended interaction klystron will be afforded to those skilled in the art, as well as a realization of additional advantages and objects thereof, by consideration of the following detailed description of the preferred embodiment. Reference will be made to the appended sheets of drawings which will be first described briefly.

BRIEF DESCRIPTION OF THE DRAWINGS

FIG. 1 is a perspective view of a cavity having a prior art inductive tuning diaphragm, partially cutaway to illustrate an internal portion of the cavity;

FIG. 2A is a diagram illustrating a desired $TM_{01}$ mode of a fundamental frequency of a resonant cavity;

FIG. 2B is a diagram illustrating an undesired TEM mode of a harmonic resonance within the resonant cavity;

FIG. 2C is a diagram illustrating an undesired $TE_{111}$ mode of a harmonic resonance within the resonant cavity;

DETAILED DESCRIPTION OF THE PREFERRED EMBODIMENT

Figure 3:
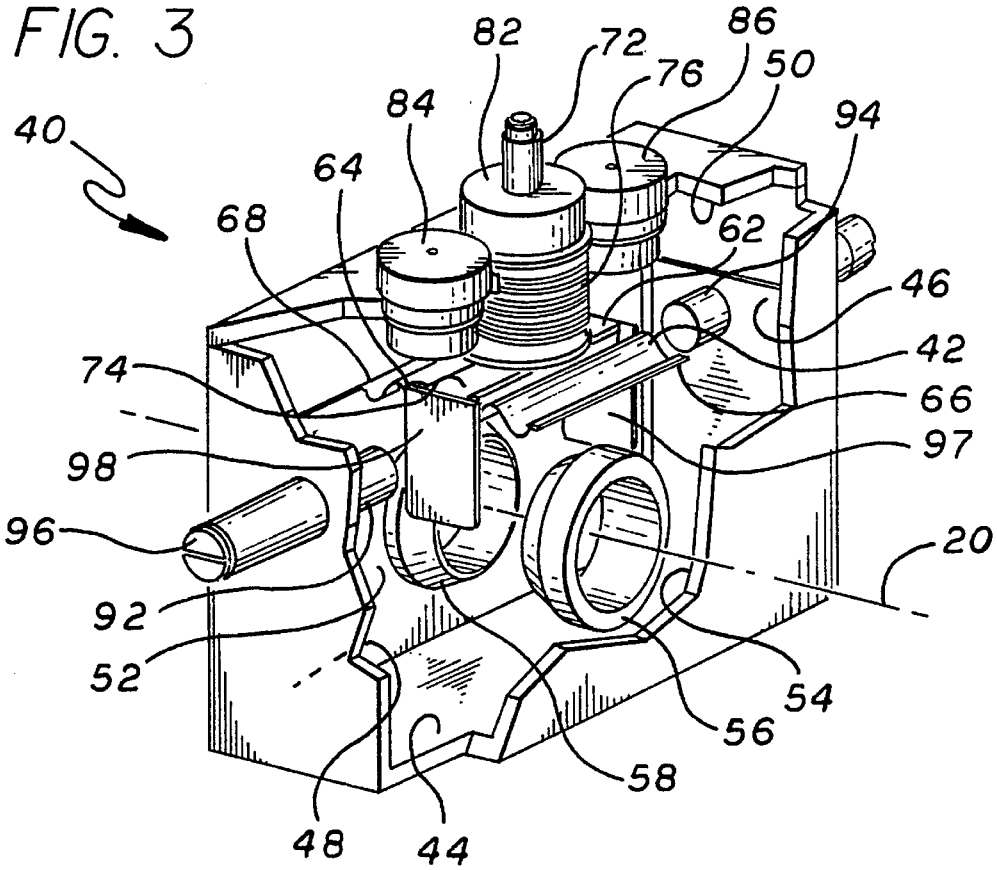
FIG. 3 is a perspective view of a combination tuner and harmonic suppressor of the present invention, partially cutaway to illustrate an internal portion of the cavity.

This invention provides an apparatus for use with an EIK that enables a broad range of cavity tuning, and that suppresses undesired harmonic resonances encountered within the cavity. The apparatus is also relatively simple to design and cost effective to fabricate.

Referring first to FIG. 1, a klystron cavity 10 having a prior art inductive tuning diaphragm 12 is illustrated. The cavity 10 is illustrated as a rectangular structure defining an internal cavity, with a drift tube section extending perpendicularly therethrough. The rectangular structure includes a lower surface 14, an upper surface provided by the diaphragm 12, a first side surface 24, a second side surface 22, a first end surface 18, and a second end surface 16. In practice, the cavity section 10 is coupled to one or more other cavity sections (not shown), as well as an electron gun (not shown) to generate the electron beam and an electron collector (not shown) to receive and dissipate the electrons of the electron beam after energy transfer to the klystron is complete. A vacuum environment is maintained within the cavity 10.

The drift tube section is aligned along an axis 20 on which the bunched electrons of an electron beam travel. The tips of the tubular shaped electron beam tunnel 26 and 28 are the re-entrant portions of the cavity. The spacing between the drift tube tips 26, 28 define the cavity gap, which will be further described below.

The diaphragm 12 is generally elliptical in shape and is comprised of a relatively thin and flexible material. The diaphragm may have a plurality of pleats to enable its flexing in a vertical direction relative to the cavity 10 substantially parallel to the lower surface 14. The diaphragm 12 may be comprised of stainless steel, having an electrically conductive surface coating, such as copper. A post 32 extends from a central portion of the diaphragm 12, and enables movement of the diaphragm. The post 32 may be manipulated by known mechanical device, such as a motor or gear drive mechanism.

As known in the art, the cavity 10 can be considered a parallel resonant LC circuit that operates at microwave frequencies. An inductor L is provided by the volume bounded by the internal surfaces of the cavity, and a capacitor C is provided by the cavity gap with the drift tube tips corresponding to plates of the capacitor. A magnetic field is concentrated in the toroidal portion of the cavity, and an electric field is concentrated in the gap portion of the cavity. At resonance, energy oscillates back and forth between the magnetic field in the toroidal portion of the cavity and the electric field in the gap portion of the cavity, just as it does in a parallel LC circuit. A modulated electron beam containing an RF current passes through the capacitive portion of the cavity and induces current onto the walls of the cavity.

It may be advantageous to tune the cavity so that it oscillates at a desired fundamental frequency defined by the inductance and capacitance of the cavity. By changing the position of the diaphragm 12, the toroidal volume changes, thus the inductance of the cavity changes. It should be apparent that the range of motion of the diaphragm 12 determines the tuning range achievable by adjustment of the diaphragm position. While tuning diaphragms as in FIG. 1 may be capable of providing modest adjustment (less than 10% of bandwidth), broader ranges are desirable for high efficiency, broad bandwidth extended interaction klystrons.

The electric and magnetic fields that are formed within the cavity may have a variety of configurations depending on the resonant characteristics of the cavity. These various field configurations are known as modes. Referring now to FIGS. 2A–2C, cavity 10 is illustrated as having a gap defined between drift tube tips 26, 28, with the direction of beam propagation denoted by the double arrows. It is most desirable that the cavity 10 have a dominant mode as illustrated in FIG. 2A, known as the $TM_{01}$ (transverse-magnetic) mode. In the $TM_{01}$ mode, the electric field is in the direction of electron beam propagation through the cavity, and is illustrated by the arrows extending across the gap. The magnetic field is generally toroidal around the cavity gap, denoted by the plus (+) symbols representing magnetic field lines going into the plane defined by the figure, and the zero (0) symbols indicating the magnetic field lines emerging from the plane of the figure. It should be apparent that in the $TM_{01}$ mode, the electric field is confined to the central region of the cavity gap.

In the same manner that the RF currents are induced in the cavity, harmonic currents may also be induced into the cavity. Since the harmonic currents are at multiples of the fundamental frequency, they will be present in different configurations than the dominant mode. FIGS. 2B and 2C illustrate undesired frequency modes of operation for the cavity. In FIG. 2B, the TEM (transverse-electric and magnetic) mode of resonance is illustrated, in which both the electric field and magnetic field are transverse to the direction of beam propagation. FIG. 2C illustrates the $TE_{111}$ (transverse-electric) mode in which the electric field is transverse to the direction of beam propagation. It should be apparent that in each of the TEM and $TE_{111}$ modes the electric field lines extend to the outer ends of the cavity. This characteristic of the harmonic modes is significant to the operation of the harmonic suppressor of the present invention, as will be apparent from the following description. Moreover, the undesired modes represent an electric field reversal within the gap that tends to break up the electron bunches in the beam, thus decreasing the fundamental component of the RF current in the beam.

Referring now to FIG. 3, a klystron cavity assembly 40 of the present invention is illustrated. As in the prior art cavity 10, the cavity 40 has a central drift tube disposed along an axis 20 of the klystron. The drift tube comprises drift tube tips 58 and 56, with a gap defined therebetween. The cavity 40 is generally rectangular in shape having a bottom surface 44, a first side surface 54, a second side surface 52, a first end surface 48, and a second end surface 46. The top surface of the resonant cavity is provided by a diaphragm 42 having a first end 64 and a second end 62. The diaphragm 42 does not provide a vacuum envelope for the cavity 40 as in the cavity 10, and does not extend from the first end surface 48 to the second end surface 46 of the structure as with the diaphragm 12 of FIG. 1. Instead, the diaphragm 42 is centrally disposed over the gap defined by the drift tube tips 58 and 56, and secures to the first side surface 54 at a first side 66 of the diaphragm, and to the second side surface 52 at a second side 68 of the diaphragm. Since the diaphragm 42 attaches to the cavity structure 40 only along a single dimension, and is not rigidly attached at ends thereof, a far greater range of motion for the diaphragm is provided over the diaphragm 12 of FIG. 1.

As explained above, the dominant $TM_{01}$ mode has electric field lines substantially centered around the drift tube region. Therefore, current induced by the RF energy of the beam is also substantially centered along the cavity surfaces, and does not extend out to the area adjacent to the end surfaces 46 and 48. Thus, it is not necessary for the diaphragm 42 to extend all the way to the end surfaces, and it is feasible to provide the diaphragm having unattached ends.

The vacuum envelope of the cavity structure 40 is provided by an upper surface 50, which is disposed above the diaphragm 42. Movement of the diaphragm 42 is provided by the post 72 extending through the upper surface 50, in cooperation with a bellows 76. The bellows 76 is circular in shape and has a plurality of pleats enabling it to be expanded and contracted along its height. The bellows 76 is sealed at a bottom portion thereof for connection to a brace 74 attached to an upper portion of the diaphragm 42 for connection to the bellows 76. As in the diaphragm 12 of FIG. 1, the post 72 can be manipulated by a mechanical device, such as a motor or gear train. The bellows 76 is compressed against the surface 50, sealing the vacuum envelope. A cup 82 disposed above the upper surface 50 encloses the post 72 which protrudes through the upper surface.

The openings disposed between the first end surface 48 and the first end 64 of the diaphragm, and the second end surface 46 and the second end 62 of the diaphragm, provide coupling irises for harmonic energy within the cavity 40. Since the harmonic modes each have electric fields which extend to the end surfaces 46, 48, RF current travels along the end surfaces and passes through the coupling irises into the space provided between the diaphragm 42 and the upper surface 50. This space is referred to herein as a back cavity or corner cavity.

Once coupled into the back cavity, the undesired RF harmonic energy can be attenuated through the use of absorber buttons 84 and 86. The absorber buttons 84, 86 are cylindrical in shape and extend through the upper surface 50 into the back cavity area so that they are substantially centrally disposed within the back cavity. The absorber buttons could be positioned a quarter of a wavelength (at the center of the second harmonic band) away from the electrical short circuit presented by the bellows 76, thereby putting them at the maximum electric field. The absorber buttons 84, 86 are comprised of a lossy material, such as a mixture of silicon carbide and beryllia, magnesia or alumina, selected for wideband RF loss so as to attenuate resonances over the entire second harmonic band. Once absorbed, the energy converts to heat that can be dissipated through a heat sink provided by the upper surface 50. The surface 50 can additionally be liquid cooled to remove the excess heat produced by the absorber buttons.

Efficient coupling of the harmonic energy into the back cavity is further achieved by use of capacitive stub tuners 92, 94. The capacitive stub 92 extends from the first end surface 48 into the plane of the first coupling iris, and the capacitive stub 94 extends from the second end surface 46 into the plane of the second coupling iris. The position of each stub 92, 94 with respect to the center of the iris alters the capacitance of the iris, allowing the iris to be optimally tuned to accept the undesired harmonic energy. Position of each respective stub 92, 94 is determined by adjustment of a threaded member 96 disposed external to the cavity 40. Clockwise rotation of the threaded member 96 causes the stub to extend further into the coupling iris to increase its capacitance, while counter-clockwise rotation causes it to withdraw from the coupling iris to decrease its capacitance. Once an optimum tuning position is obtained for each stub 92, 94, the threaded member 96 is fixed in position by brazing, welding, or other such technique to permanently seal the vacuum within the cavity 40.

The stubs provide capacitive perturbations extending from the end surfaces 46, 48 adjacent to the coupling irises. The placement of the stubs near the coupling irises at both ends of the diaphragm 42 provides that even in the case of the orthogonal $TE_{111}$ mode, the harmonics will be coupled to the back cavities behind the tuner diaphragm. The coupling is further enhanced by adjusting the stub length so as to cause the coupling irises to be resonant in the second harmonic frequency range. In order to keep the coupling iris capacitance independent of the inductive tuner position, tabs 98, 97 are positioned at each end of the diaphragm 42 substantially perpendicular to the plane of the diaphragm such that the stub-to-tab distance remains constant regardless of the diaphragm position. Since the $TM_{01}$ mode has an electric field intensity of practically zero at the stub locations, coupling of fundamental energy into the back cavities is negligible.

Figure 4:
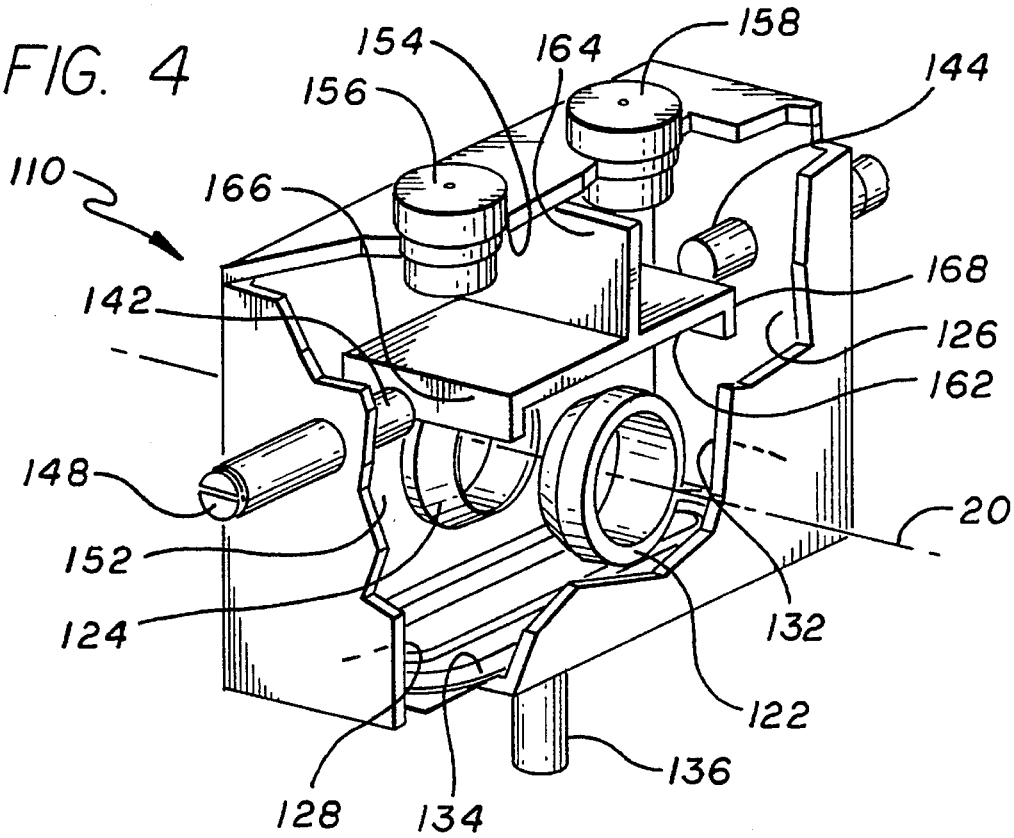
FIG. 4 is a perspective view of an alternative embodiment of a tuner and harmonic suppressor of the present invention, partially cutaway to illustrate an internal portion of the cavity.

An alternative embodiment of the cavity 40 is illustrated in FIG. 4. A klystron cavity 110 has a central drift tube disposed along an axis 20 of the klystron. The drift tube comprises drift tube tips 122 and 124, with a gap defined therebetween. The cavity 110 is generally rectangular in shape having a first side surface 132, a second side surface 152, a first end surface 128, and a second end surface 126. The bottom surface of the resonant cavity is provided by a diaphragm 134. As in the diaphragm 12 of FIG. 1, the diaphragm 134 is generally elliptical in shape and comprised of a relatively thin, flexible, electrically conductive material. A post 136 extends downwardly from an outer central portion of the diaphragm 134, and enables movement of the diaphragm. The post 136 may be manipulated by known mechanical device, such as a motor or gear drive mechanism.

The cavity 110 further comprises an inverted T-shaped member having a vertical partition wall 164 and a horizontal partition wall 162. The vertical partition wall 164 extends from a central portion of the horizontal partition wall 162. The underside of the horizontal partition wall 162 provides a top surface for the resonant cavity 110. As described above with respect to FIG. 3, the dominant $TM_{01}$ mode has electric field lines substantially centered around the drift tube region, and accordingly, the current induced by the RF energy of the electron beam is substantially centered along the cavity surfaces. Thus, it is not necessary for the horizontal partition wall 162 to extend all the way to the end surfaces 128 and 126.

The vacuum envelope of the cavity structure 110 is provided by an upper surface 154, which is disposed above and parallel to the horizontal partition wall 162. The vertical partition wall 164 extends between the horizontal partition wall 162 and the upper surface 154. The openings disposed between the first end surface 128 and a first end 166 of the horizontal partition wall 162, and the second end surface 126 and the second end 168 of the horizontal partition wall provide coupling irises for harmonic energy within the cavity structure 110. As in the embodiment of FIG. 3, the spaces disposed between the horizontal partition wall 162 and the upper surface 154 are referred to as back cavities. The undesired RF harmonic energy can be coupled into these back cavities. Absorber buttons 156 and 158 extend through the upper surface 154 into each respective back cavity so that they are substantially centrally disposed within each respective back cavity. The absorber buttons could be positioned a quarter of a wavelength (at the center of the second harmonic band) away from the electrical short circuit presented by the horizontal partition wall 162, thereby putting them at the maximum electric field. The upper surface 154 can be liquid cooled to remove excess heat generated by the absorber buttons 156, 158 in absorbing the RF harmonic energy.

Efficient coupling of the harmonic energy into the back cavities is further achieved by use of capacitive stub tuners 142, 144. The capacitive stub 142 extends from the first end surface 128 into the plane of the first coupling iris, and the capacitive stub 144 extends from the second end surface 126 into the plane of the second coupling iris. The position of each respective stub with respect to the center of the coupling iris alters the capacitance of the coupling iris, allowing the coupling iris to be tuned to optimally accept the undesired harmonic energy. A threaded member 148 enables adjustment of the position of the stub 142, in the same manner as described above with respect to threaded member 96 of FIG. 3. Tabs 166,168 provide surfaces parallel to end surfaces 128, 126 to formulate the coupling irises.

Figure 5:
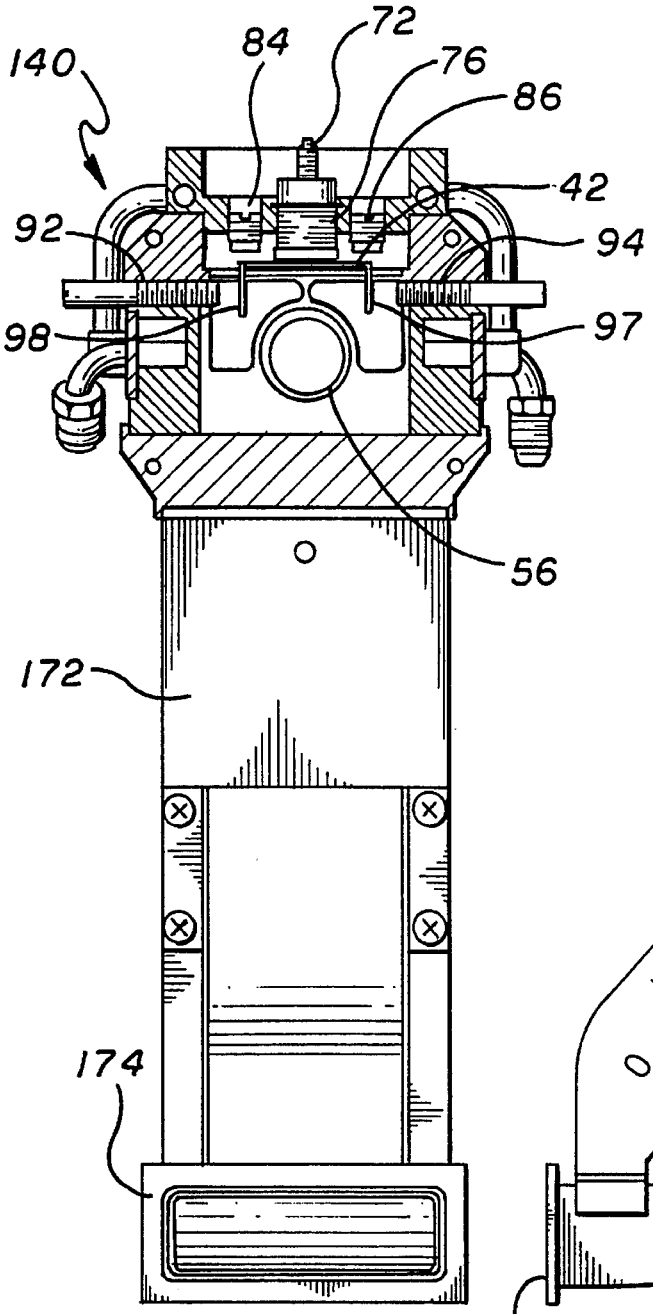
FIG. 5 is a front partial sectional view of an extended interaction output circuit having the combination tuner and harmonic suppressor of the present invention, as taken through the section 5—5 of FIG. 6.
Figure 6:
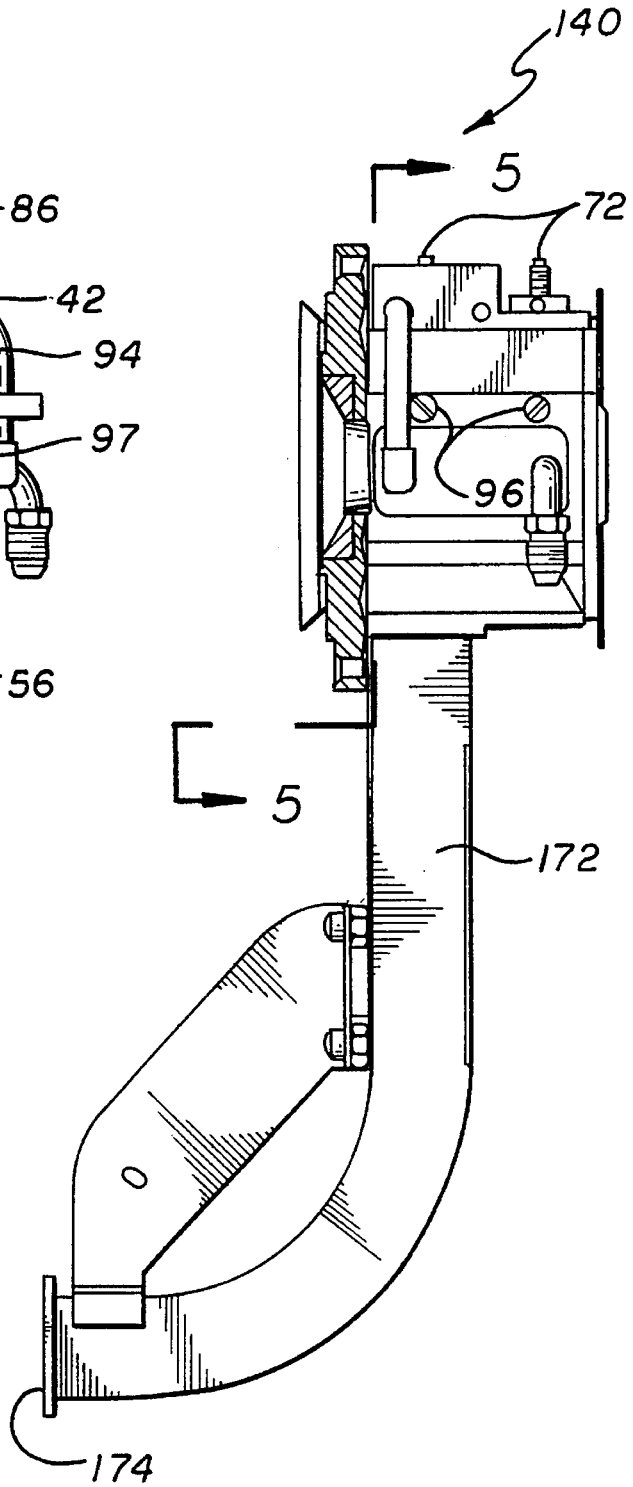
FIG. 6 is a side view of the extended interaction output circuit of FIG. 5.

Referring now to FIGS. 5 and 6, an extended interaction output circuit 140 coupled to an output waveguide 172 is illustrated. The extended interaction output circuit 140 may comprise a portion of a klystron which includes an electron gun (not shown) to provide an electron beam along an axis of the extended interaction output circuit (not shown), and a collector (not shown) to receive the spent electrons of the modulated electron beam after exiting the extended interaction output circuit. The output waveguide 172 couples output RF energy from the klystron to an output port having a flange 174 disposed at an end of the waveguide.

The extended interaction output circuit 140 of FIGS. 5 and 6 contains two serially disposed cavities, each being substantially as disclosed above with respect to FIG. 3. In FIG. 5, each of the serially disposed cavities of the extended interaction output circuit 140 has a drift tube section including drift tube end tip 56. Centrally disposed above the drift tube section is the diaphragm 42 having end tabs 98, 97. Movement of the diaphragm 42 is controlled by post 72 in cooperation with bellows 76 (not shown). The bellows 76 provides a vacuum envelope for the extended interaction output circuit. Back cavities are formed above the diaphragm 42 into which absorber buttons 84, 86 extend. Coupling irises provided between the back cavities and the resonant portion of the cavity below the diaphragm 42 are capacitively tuned by tuner stubs 92, 94. The capacitive tuner stubs 92, 94 are adjustable by use of threaded members 96 (see FIG. 6). The extended interaction output circuit 140 may further be liquid cooled through use of plumbing inlet 147 and outlet 149 (see FIG. 6.)

Having thus described the preferred embodiment of a combination tuner and second harmonic suppressor for an extended interaction klystron, it should now be apparent to those skilled in the art that certain advantages of the system have been achieved. It should also be appreciated by those skilled in the art that various modifications, adaptations, and alternative embodiments thereof may be made within the scope and spirit of the present invention.

The present invention is further defined by the following claims.

What is claimed is:

1. In a harmonic suppressing apparatus usable with a klystron having a respective gap defined across at least one resonant cavity and having harmonic energy contained therein, the harmonic suppressing apparatus comprising:

a corner cavity coupled to said resonant cavity by at least one coupling iris, said harmonic energy within said resonant cavity being conducted to said corner cavity through said at least one coupling iris; and means disposed within said corner cavity for absorbing said harmonic energy, said absorbing means substantially attenuating said harmonic resonances.

2. The apparatus of claim 1, further comprising means for tuning said at least one coupling iris, said tuning means being coupled to an end of said resonant cavity, and said tuning means being adjustable to vary capacitance of said at least one coupling iris.

3. The apparatus of claim 2, wherein said tuning means further comprises a threaded capacitive stub extending across said at least one coupling iris.

4. The apparatus of claim 1, wherein said absorbing means further comprises an RF absorber button comprised of a lossy material.

5. The apparatus of claim 1, wherein said corner cavity is disposed at an end of said resonant cavity and separated from said resonant cavity by a partition wall extending across said resonant cavity adjacent to said gap.

6. The apparatus of claim 5, wherein said at least one coupling iris is disposed between a side edge of said partition wall and a side surface of said resonant cavity.

7. The apparatus of claim 1, wherein said klystron is an extended interaction klystron having two resonant cavities.

8. In a tuning apparatus usable with a klystron having a drift tube permitting the traveling therethrough of a modulated electron beam emitted by an electron-emitting source within said klystron, the drift tube including a respective gap defined across at least one resonant cavity having a resonant frequency and having harmonic energy contained therein, the tuning apparatus comprising:

a corner cavity coupled to said resonant cavity by at least one coupling iris, said harmonic energy being conducted from said resonant cavity to said corner cavity through said at least one coupling iris;

means for inductively tuning said resonant frequency of said resonant cavity, said inductive tuning means being attached to said resonant cavity; and means disposed within said corner cavity for absorbing said harmonic energy, said absorbing means substantially attenuating said harmonic energy.

9. The apparatus of claim 8, further comprising means for capacitively tuning said at least one coupling iris, said capacitive tuning means being coupled to said resonant cavity, and said capacitive tuning means being adjustable.

10. The apparatus of claim 9, wherein said capacitive tuning means further comprises a threaded stub extending across said at least one coupling iris.

11. The apparatus of claim 8, wherein said absorbing means further comprises an RF absorber button comprised of a lossy material.

12. The apparatus of claim 11, wherein said RF absorber button is comprised of silicon carbide.

13. The apparatus of claim 8, wherein said inductive tuning means further comprises a diaphragm providing a wall of said resonant cavity, and means for manipulating said diaphragm to change a position of said wall.

14. The apparatus of claim 13, wherein said diaphragm extends across said cavity adjacent to said gap, and said corner cavity is separated from said resonant cavity by said diaphragm.

15. The apparatus of claim 14, wherein said manipulating means further comprises a bellows coupled to said diaphragm, said bellows providing a barrier between a vacuum environment within said klystron and a non-vacuum environment external to said klystron.

16. The apparatus of claim 14, wherein said diaphragm is open at side edges thereof, said at least one coupling iris being disposed between a side edge of said diaphragm and a side surface of said resonant cavity.

17. The apparatus of claim 13, wherein said diaphragm is disposed at an end of said resonant cavity opposite from said corner cavity.

18. The apparatus of claim 8, wherein said klystron is an extended interaction klystron having two resonant cavities.

19. A tuning apparatus usable with a klystron having a drift tube permitting the traveling therethrough of a modulated electron beam emitted by an electron-emitting source within said klystron, the drift tube including a respective gap defined across at least one resonant cavity having a resonant frequency and harmonic energy contained therein, the tuning apparatus comprising:

a corner cavity coupled to said resonant cavity by at least one coupling iris, said harmonic energy being conducted from said resonant cavity to said corner cavity through said at least one coupling iris;

means for capacitively tuning said at least one coupling iris, said capacitive tuning means being operatively coupled to said resonant cavity, said capacitive tuning means being adjustable;

means for inductively tuning said resonant frequency of said resonant cavity, said inductive tuning means being operatively coupled to said resonant cavity; and means disposed within said corner cavity for absorbing said harmonic energy, said absorbing means substantially attenuating said harmonic energy.

20. The apparatus of claim 19, wherein said capacitive tuning means further comprises a threaded stub extending across said at least one coupling iris.

21. The apparatus of claim 19, wherein said absorbing means further comprises an RF absorber button comprised of a generally lossy material.

22. The apparatus of claim 19, wherein said inductive tuning means further comprises a diaphragm providing a wall of said resonant cavity, and means for manipulating said diaphragm to change a position of said wall relative to said resonant cavity.

23. The apparatus of claim 22, wherein said diaphragm extends across said cavity adjacent to said gap, and said corner cavity is separated from said resonant cavity by said diaphragm.

24. The apparatus of claim 22, wherein said manipulating means further comprises a bellows coupled to said diaphragm, said bellows providing a barrier between a vacuum environment within said klystron and a non-vacuum environment external to said klystron.

25. The apparatus of claim 22, wherein said diaphragm is open at side edges thereof, said at least one coupling iris being disposed between a side edge of said diaphragm and a side surface of said resonant cavity.

26. The apparatus of claim 25, further comprising a tab extending from said side edge of said diaphragm perpendicularly with said inductive tuning means.

27. The apparatus of claim 22, wherein said diaphragm is disposed at an end of said resonant cavity opposite from said corner cavity.

28. The apparatus of claim 27, wherein said diaphragm provides a barrier between a vacuum environment within said klystron and a non-vacuum environment external to said klystron.

29. The apparatus of claim 19, wherein said klystron has two resonant cavities.

30. A harmonic suppressing apparatus usable with a klystron having a gap defined across a resonant cavity and undesired energy at modes other than a desired mode contained therein, the apparatus comprising:

a plurality of corner cavities coupled to said resonant cavity by at least one coupling iris, said undesired energy within said resonant cavity being conducted to said corner cavities through said at least one coupling iris; and means disposed within said corner cavities for absorbing said undesired energy, said absorbing means substantially attenuating said undesired energy.

* * * * *